US010895192B1

(12) United States Patent
Smith et al.

(10) Patent No.: US 10,895,192 B1
(45) Date of Patent: Jan. 19, 2021

(54) DUAL PUMP SYSTEM AND METHOD FOR COOLING AN ENGINE OF A MOTOR VEHICLE

(71) Applicant: GM Global Technology Operations LLC, Detroit, MI (US)

(72) Inventors: Michael A. Smith, Clarkston, MI (US); Scott K. Wilson, Oxford, MI (US); Eugene V. Gonze, Pinckney, MI (US); James B. Hicks, Washington Township, MI (US); Sergio Quelhas, Ann Arbor, MI (US); Anthony J. Corsetti, Rochester Hills, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 16/531,754

(22) Filed: Aug. 5, 2019

(51) Int. Cl.

| | |
|---|---|
| ***F02P 5/12*** | (2006.01) |
| ***F01P 5/12*** | (2006.01) |
| ***F04D 15/00*** | (2006.01) |
| ***F01P 7/16*** | (2006.01) |
| *F01P 7/14* | (2006.01) |
| *F01P 3/02* | (2006.01) |

(52) U.S. Cl.
CPC ..... *F01P 5/12* (2013.01); *F01P 7/16* (2013.01); *F04D 15/0094* (2013.01); *F01P 3/02* (2013.01); *F01P 2005/125* (2013.01); *F01P 2007/146* (2013.01)

(58) Field of Classification Search
USPC ..... 123/41.02, 41.44, 41.48, 198 C
See application file for complete search history.

(56) References Cited

U.S. PATENT DOCUMENTS

| | | | | |
|---|---|---|---|---|
| 6,786,183 | B2 * | 9/2004 | Hoelle | B60H 1/08 123/41.44 |
| 10,054,033 | B2 | 8/2018 | Watanabe | |
| 2017/0321594 | A1 | 11/2017 | Gonze et al. | |

* cited by examiner

*Primary Examiner* — George C Jin
*Assistant Examiner* — Teuta B Holbrook

(57) ABSTRACT

The present disclosure provides an engine cooling system for controlling the temperature of an engine of a motor vehicle. The system includes an engine cooling circuit for circulating a coolant to transfer heat from the engine to an airflow. An electric water pump is configured to circulate the coolant through the circuit at a maximum electric pump flow rate, and a mechanical water pump is configured to circulate the coolant through the circuit at a maximum mechanical pump flow rate that is higher than the maximum electric pump flow rate. The circuit further includes a selector valve configured to fluidly connect one of the electric water pump and the mechanical water pump to the engine. An engine control module generates a valve signal for actuating the selector valve to fluidly connect one of the electric water pump and the mechanical water pump to the engine.

20 Claims, 3 Drawing Sheets

DUAL PUMP SYSTEM AND METHOD FOR COOLING AN ENGINE OF A MOTOR VEHICLE

INTRODUCTION

The present disclosure relates to an engine cooling system for a motor vehicle, and more particularly to an engine cooling system including an electric water pump and a mechanical water pump for efficiently handling a range of thermal loads and improving fuel economy.

Engine cooling systems include mechanical water pumps driven by drive belts or gears running at a specific transmission ratio, which are in turn driven by the crankshaft of the engine. Because engine speed does not necessarily determine the thermal requirements of a vehicle, the mechanical water pump may not circulate coolant at flow rates proportional with the specific thermal requirements of the vehicle. Manufacturers select the specific transmission ratio, as well as the pump impeller pitch and general design, in order to provide coolant flow rates that protect the engine under high load conditions. Examples of these high load conditions can include climbing steep hills, towing, driving in atmospheres with high ambient temperatures, or combinations of these conditions. However, when less cooling is required at the same engine speeds, the mechanical water pump still provides the same coolant flow rates that were used under high load conditions.

Thus, while current engine cooling systems achieve their intended purpose, there is a need for a new and improved engine cooling system and method that addresses these issues.

SUMMARY

According to several aspects, an engine cooling system for controlling the temperature of an engine of a motor vehicle is provided. The system includes a fan for creating an airflow. The system further includes an engine cooling circuit for circulating a coolant to transfer heat from the engine to the airflow. The circuit includes an electric water pump configured to circulate the coolant through the circuit at a maximum electric pump flow rate. The circuit further includes a mechanical water pump configured to circulate the coolant through the circuit at a maximum mechanical pump flow rate. The circuit further includes a selector valve configured to fluidly connect one of the electric water pump and the mechanical water pump to the engine. The system further includes one or more input sensors configured to measure at least one characteristic of energy demand on the engine and generate a signal representative of the measured energy demand characteristic. The system further includes an engine control module (ECM) electrically coupled to the electric water pump, the mechanical water pump, the selector valve, and the input sensors. The ECM includes a memory that contains energy demand data associated with a predetermined flow rate. The ECM is configured to compare the energy demand characteristics as measured by the input sensors to the energy demand data, such that the ECM identifies the predetermined flow rate. The ECM is further configured to compare the predetermined flow rate to the maximum electric pump flow rate. Based on the latter comparison, the ECM is configured to generate a valve signal for actuating the selector valve to fluidly connect one of the electric water pump and the mechanical water pump to the engine.

In one aspect, the maximum mechanical pump flow rate is higher than the maximum electric pump flow rate.

In another aspect, the ECM is configured to generate a valve signal for actuating the selector valve to fluidly connect the electric water pump to the engine, in response to the ECM determining that the predetermined flow rate is at or below the maximum electric pump flow rate.

In another aspect, the ECM is configured to actuate the electric water pump to circulate coolant in the circuit, in response to the ECM determining that the predetermined flow rate is at or below the maximum electric pump flow rate.

In another aspect, the ECM is further configured to generate a valve signal for actuating the selector valve to fluidly connect the mechanical water pump to the engine, in response to the ECM determining that the predetermined flow rate is above the maximum electric pump flow rate.

In another aspect, the system further includes a clutch coupled to the engine and the mechanical water pump. The clutch is movable between an engaged state where the clutch transmits torque from the engine to the mechanical water pump and a disengaged state where the clutch does not transmit torque from the engine to the mechanical water pump. The ECM is configured to generate a clutch signal for actuating the clutch to move to one of the disengaged state and the engaged state, based on the comparison between the predetermined flow rate and the maximum electric pump flow rate.

In another aspect, the clutch is moved to the engaged state for a period of time equal to or exceeding a minimum time threshold, in response to the ECM determining that the predetermined flow rate is above the maximum electric pump flow rate.

In another aspect, the clutch is moved to the disengaged state, in response to the ECM determining that the predetermined flow rate is at or below the maximum electric pump flow rate.

According to several aspects, an engine cooling system for controlling the temperature of an engine of a motor vehicle is provided. The system includes a fan for creating an airflow. The system further includes an engine cooling circuit for circulating a coolant to transfer heat from the engine to the airflow. The circuit further includes an electric water pump configured to draw a maximum current to circulate the coolant through the circuit at a maximum electric pump flow rate. The electric water pump may include a brushless DC motor, a brushed DC motor, or an AC motor. The circuit further includes a mechanical water pump configured to circulate the coolant through the circuit at a maximum mechanical pump flow rate, which is higher than the maximum electric pump flow rate. The circuit further includes a selector valve configured to fluidly connect one of the electric water pump and the mechanical water pump to the engine. The system further includes one or more input sensors configured to measure at least one characteristic of energy demand on the engine and generate a signal representative of the measured energy demand characteristic. The system further includes an engine control module (ECM) electrically coupled to the electric water pump, the mechanical water pump, the selector valve, and the input sensors. The ECM includes a memory that contains energy demand data associated with a predetermined flow rate and a predetermined current for the electric water pump. The ECM is configured to compare the energy demand characteristics as measured by the input sensors to the energy demand data for identifying the predetermined flow rate and the predetermined current. The ECM is further configured to compare the predetermined flow rate to the maximum electric pump flow rate, and the ECM is configured to compare the predetermined current to the maximum current. Based on these comparisons, the ECM is configured to generate a valve signal for actuating the selector valve to fluidly connect one of the electric water pump and the mechanical water pump to the engine.

In one aspect, in response to the ECM determining that the predetermined flow rate is at or below the maximum electric pump flow rate and in further response to the ECM determining that the predetermined current is at or below the maximum current, the ECM is configured to actuate the electric water pump to circulate coolant at the predetermined flow rate.

In another aspect, in response to the engine control module determining that the mechanical water pump has been circulating coolant for a time period equal to or exceeding a minimum time threshold, the ECM is configured to deactivate the mechanical water pump and generate the valve signal for actuating the selector valve to fluidly connect the electric water pump to the engine.

In another aspect, in response to the ECM determining that the predetermined flow rate is at or below the maximum electric pump flow rate, the ECM is configured to actuate the electric water pump to circulate coolant and generate the valve signal for actuating the selector valve to fluidly connect the electric water pump to the engine.

In another aspect, in response to the engine control module determining that the predetermined current is above the maximum current, the engine control module is configured to actuate the mechanical water pump to circulate coolant and generate the valve signal for actuating the selector valve to fluidly connect the mechanical water pump to the engine.

In another aspect, the system further includes a clutch coupled to the engine and the mechanical water pump. The clutch is movable between an engaged state where the clutch transmits torque from the engine to the mechanical water pump and a disengaged state where the clutch does not transmit torque from the engine to the mechanical water pump. The ECM is configured to generate a clutch signal for actuating the clutch to move to the disengaged state, in response to the ECM determining that the predetermined flow rate is at or below the maximum electric pump flow rate and in further response to the ECM determining that the predetermined current is at or below the maximum current.

In another aspect, the ECM is configured to generate a clutch signal for actuating the clutch to move to the engaged state, in response to the electronic control module determining that at least one of: the predetermined flow rate is above the maximum electric pump flow rate; and the predetermined current is above the maximum current.

In another aspect, the ECM further includes a recirculation passage, which has an inlet coupled to the selector valve downstream of the mechanical water pump and an outlet coupled to the engine cooling circuit upstream of the mechanical water pump. The ECM generates the valve signal for actuating the selector valve to fluidly connect the mechanical water pump to the recirculation passage, in response to the ECM determining that the predetermined flow rate is at or below the maximum electric pump flow rate and in further response to the ECM determining that the predetermined current is at or below the maximum current.

According to several aspects, a method for operating an engine cooling system to control the temperature of an engine of a motor vehicle is provided. The system includes a fan and an engine cooling circuit. The circuit includes an electric water pump configured to draw a maximum current to circulate coolant at a maximum electric pump flow rate, a mechanical water pump configured to circulate coolant at a maximum mechanical pump flow rate that is higher than the maximum electric pump flow rate, and a selector valve. The system further includes one or more input sensors and an engine control module (ECM) electrically coupled to the electric water pump, the mechanical water pump, the selector valve, and the input sensors. The ECM includes a memory that contains energy demand data associated with a predetermined flow rate and a predetermined current. The method includes using the input sensors to measure at least one characteristic of energy demand on the engine. The method further includes using the input sensors to generate a signal representative of the measured energy demand characteristic. The method further includes using the ECM to compare the energy demand characteristics as measured by the input sensors to energy demand data, which is associated with predetermined flow rates and predetermined currents. The ECM compares the predetermined flow rate to the maximum electric pump flow rate, and the ECM compares the predetermined current to the maximum current. Based on these comparisons, the ECM actuates one of the electric water pump and the mechanical water pump to circulate coolant and the ECM is further configured to generate a valve signal for actuating the selector valve to fluidly connect one of the electric water pump and the mechanical water pump to the engine.

In one aspect, in response to the ECM determining that the predetermined flow rate is at or below the maximum electric pump flow rate and in further response to the ECM determining that the predetermined current is at or below the maximum current, the ECM generates a valve signal for actuating the selector valve to fluidly connect the electric water pump to the engine, and the ECM actuates the electric water pump to circulate coolant at the predetermined flow rate in the engine cooling circuit.

In another aspect, in response to the ECM determining that the mechanical water pump has been circulating coolant for a time period equal to or exceeding a minimum time threshold, the ECM deactivates the mechanical water pump and generates the valve signal for actuating the selector valve to fluidly connect the electric water pump to the engine.

In another aspect, in response to the ECM determining that the predetermined flow rate is above the maximum electric pump flow rate or in response to the ECM determining that the predetermined current is above the maximum current for a given voltage, the ECM generates a valve signal for actuating the selector valve to fluidly connect the mechanical water pump to the engine, and the ECM actuates the mechanical water pump to circulate coolant in the engine cooling circuit.

Further areas of applicability will become apparent from the description provided herein. It should be understood that the description and specific examples are intended for purposes of illustration only and are not intended to limit the scope of the present disclosure.

DETAILED DESCRIPTION

The following description is merely exemplary in nature and is not intended to limit the present disclosure, application, or uses.

Figure 1:
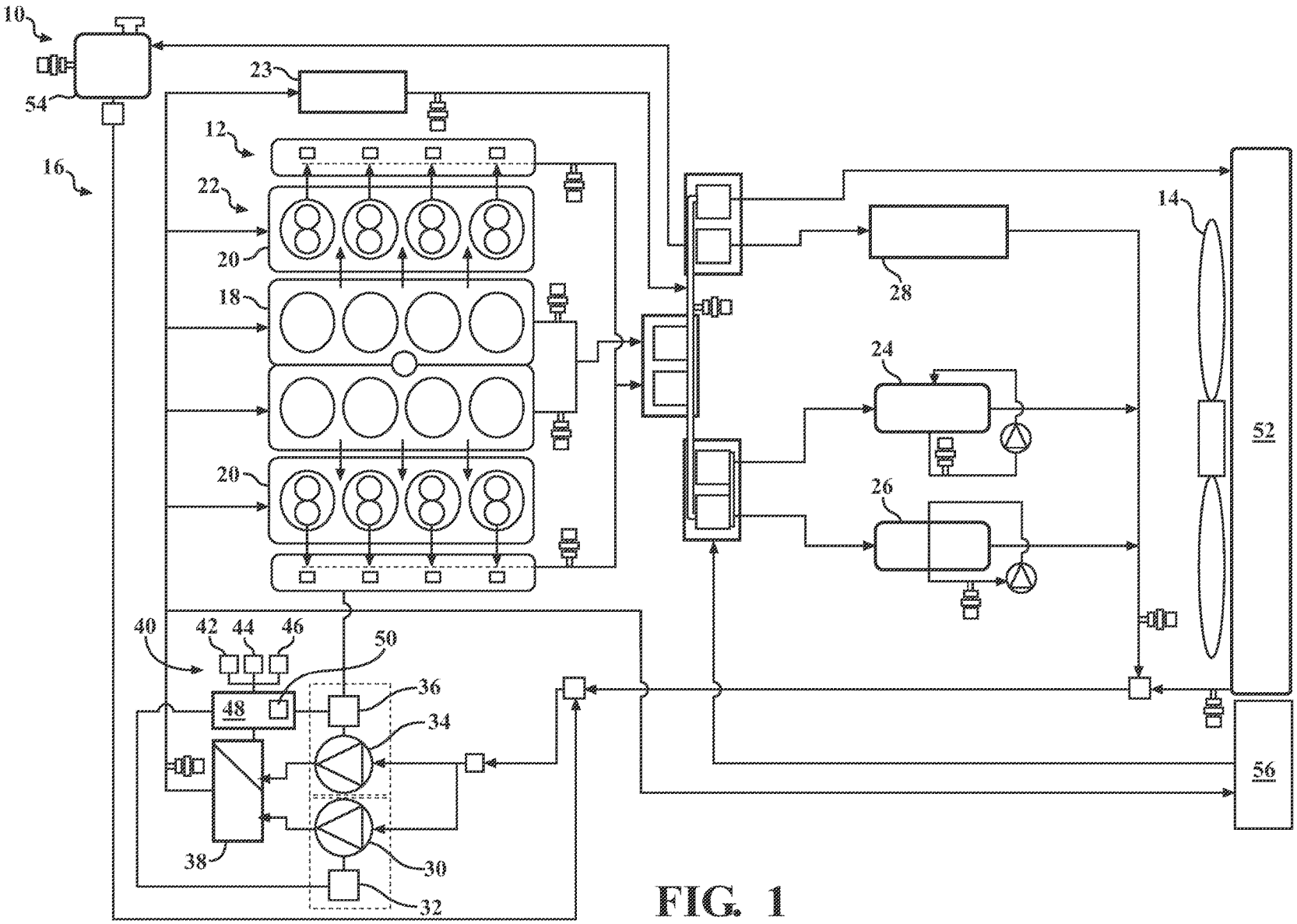
FIG. 1 is a schematic view of one embodiment of an engine cooling system for controlling the temperature of an engine of a motor vehicle.

Referring to FIG. 1, there is illustrated an engine cooling system 10 for controlling the temperature of an internal combustion engine 12 of a motor vehicle. The system 10 includes a fan 14 for creating an airflow and an engine cooling circuit 16 for circulating coolant to transfer heat from the engine 12 to the airflow as described in greater detail below.

The engine 12 has a main body including a cylinder block 18, a cylinder head 20, and a water jacket 22 formed in the main body. The water jacket 22 forms multiple coolant passages fluidly connected to the circuit 16 to circulating coolant and transferring heat from the engine block 18 and the cylinder head 20 to the coolant. In this example, an exhaust gas heat recovery system 23 may be fluidly connected to the circuit 16 to transfer heat to the coolant. In addition, an engine oil heater 24, a transmission oil heater 26, and a heater core 28 used in a climate control system for a passenger cabin may be fluidly connected to the circuit 16 downstream of the engine 12 to receive heat from the coolant. It is contemplated that the engine cooling system 10 can exchange heat with other components of a motor vehicle.

The system 10 includes an electric water pump 30 configured to circulate the coolant through the circuit 16 at a maximum electric pump flow rate. In this example, the cooling capacity of the electric water pump 30 provides coolant flow rates suitable for part load conditions where thermal requirements can be associated with, for example, driving on flat ground at constant speeds without hauling any loads. The electric water pump 30 includes an impeller and an electric-driven motor for rotating the impeller. The maximum electric pump flow rate may be proportional to the size of the impeller and the electric-driven motor. Examples of the electric-driven motor include a brushed DC motor with a plurality of mechanical commutator contacts or a brushless DC motor with an electronic servo system. The motor may be a variable speed electric motor 32 configured to circulate the coolant within a range of flow rates up to the maximum electric pump flow rate where the motor 32 draws its maximum current. It is contemplated that the electric water pump can include any suitable electric-driven motor.

The circuit 16 further includes a mechanical water pump 34 configured to circulate coolant through the circuit 16 at a maximum mechanical pump flow rate, which in this example is higher than the maximum electric pump flow rate. In this respect, the mechanical water pump 34 has a higher cooling capacity than the electric water pump 30. The difference between the maximum flow rates of the two pumps enable the mechanical water pump 34 to satisfy higher thermal requirements, relative to the electric water pump 30, when the motor vehicle is under higher load conditions. For instance, the mechanical water pump 34 can be configured to have a cooling capacity with a maximum coolant flow rate suitable for cooling the engine while climbing steep grades, hauling, passing, and driving in atmospheres with high ambient temperatures. In this example, the mechanical water pump 34 includes an impeller and an impeller driveshaft that is coupled to and driven by the engine 12. In other embodiments, the mechanical water pump may be configured to circulate coolant through the circuit at a maximum mechanical pump flow rate, which is lower than the maximum electric pump flow rate. For instance, a hybrid electric vehicle (HEV) may include an electric water pump configured to circulate coolant through the circuit a maximum electrical pump flow rate that is higher than the maximum mechanical pump flow rate when accessory electrical equipment does not draw current.

The system 10 further includes a clutch 36 coupled to the engine 12 and the mechanical water pump 34. The clutch 36 is movable between an engaged state, where the clutch 36 transmits torque from the engine 12 to the impeller driveshaft of the mechanical water pump 34, and a disengaged state, where the clutch 36 does not transmit torque from the engine 12 to the impeller driveshaft of the mechanical water pump 34. Because the mechanical water pump 34 does not receive torque from the engine 12 when the clutch 36 is moved to the disengaged state and the electric water pump 30 is engaged, the system 10 can reduce parasitic draw of the mechanical water pump 34 on the engine 12. However, other embodiments of the system may not include the clutch where, for example, the impeller driveshaft is continuously driven by the engine 12 and the mechanical water pump is selectively coupled to a recirculation loop.

The circuit 16 further includes a flow control valve or a selector valve 38 configured to fluidly connect one of the electric water pump 30 and the mechanical water pump 34 to the engine 12, based upon the thermal requirements of the motor vehicle. In this example, the selector valve 38 may include a solenoid switch and a check valve. More specifically, the selector valve 38 may include a solenoid configured to be energized for disposing the valve 38 in fluid connection between the electric water pump 30 and the engine 12. The selector valve 38 may further include a biasing member for disposing the valve 38 in fluid connection between the mechanical water pump 34 and the engine 12 when the solenoid is not energized. However, it is contemplated that the circuit can include any suitable selector valve.

The system 10 further includes one or more input sensors 40 configured to measure at least one characteristic of energy demand on the engine 12 and generate a signal representative of the same. Examples of these sensors 40 include a crank angle sensor 42 for detecting a speed of the engine 12, a throttle position sensor 44 (TPS) for detecting an accelerator opening degree, a switch 46 for switching on or off the heater used in a climate control system for a passenger cabin, other suitable input sensors, or any combination thereof.

The system 10 further includes an engine control module 48 (ECM) electrically coupled to the electric water pump 30, the mechanical water pump 34, the selector valve 38, and the input sensors 40, such that the ECM 48 actuates the pumps 30, 34 and the valve 38 to manage the thermal requirements of the vehicle based on measurements taken by the sensors 40. More specifically, the ECM 48 includes a memory 50 that contains energy demand data associated with predetermined coolant flow rates and predetermined currents for the electric water pump. It is contemplated that the memory can include a lookup table with energy measurement data associated with any suitable parameter that can be regulated by the system 10 to manage the thermal requirements of the vehicle.

The ECM 48 is configured to compare the energy demand characteristics as measured by the sensors 40 to the energy demand data stored in the memory 50 so as to identify the predetermined flow rate and the predetermined current which satisfy the current thermal requirements. The ECM 48 is further configured to compare the predetermined flow rate to the maximum electric pump flow rate and also compare the predetermined current to the maximum current for the electric water pump 30. Based on these comparisons, the ECM 48 is configured to generate a valve signal for actuating the selector valve 38 to fluidly connect one of the electric water pump 30 and the mechanical water pump 34 to the engine 12. Also, based on these comparisons, the ECM 48 is configured to generate a clutch signal to move the clutch 36 to one of the disengaged state and the engaged state.

More specifically, in response to the ECM determining that the predetermined flow rate is at or below the maximum electric pump flow rate, the ECM 48 is configured to supply the predetermined current to the electric water pump 30 and actuate the electric water pump 30 to circulate coolant at the predetermined flow rate. Also, the ECM 48 is configured to generate the valve signal for actuating the selector valve 38 to fluidly connect the electric water pump 30 to the engine 12. In this example, the ECM is further configured to generate the clutch signal for actuating the clutch 36 to move to the disengaged state such that the mechanical water pump 34 does not receive torque from the engine 12. In this example, the clutch 36 remains in the disengaged state for a period of time equal to or exceeding a minimum time threshold to prevent the clutch 36 from rapidly cycling between engaged and disengaged states in a closed loop control method. However, other embodiments do not include a clutch, such that the mechanical water pump continuously operate even when the electric water pump circulates coolant in the circuit.

In response to the ECM 48 determining that the predetermined flow rate is above the maximum electric pump flow rate, the ECM 48 is configured to generate the clutch signal for actuating the clutch 36 to move to the engaged state, such that the clutch 36 transmits torque from the engine 12 to the mechanical water pump 34. In addition, the ECM 48 is configured to generate the valve signal for actuating the selector valve 38 to fluidly connect the mechanical water pump 34 to the engine 12, such that the mechanical water pump 34 circulates coolant in the circuit 16. Furthermore, the ECM is configured to deactivate the electric water pump 30.

In response to the ECM 48 determining that the predetermined current is below the maximum current that can be drawn by the electric water pump 30, the ECM 48 is configured to supply the predetermined current to the electric water pump 30 and actuate the electric water pump 30 to circulate coolant in the circuit 16 at the predetermined flow rate. The ECM 48 is also configured to generate the valve signal for actuating the selector valve 38 to fluidly connect the electric water pump 30 to the engine 12. The ECM 48 is also configured to generate the clutch signal for actuating the clutch 36 to move to the disengaged state.

In response to the ECM 48 determining that the predetermined current is above the maximum current that can be drawn by the electric water pump 30, the ECM 48 is configured to generate the clutch signal for actuating the clutch to move to the engaged state. The ECM 48 is also configured to generate the valve signal for actuating the selector valve 38 to fluidly connect the mechanical water pump 34 to the engine 12.

The circuit 16 further includes a radiator 52 disposed proximal to the fan 14 and configured to transfer heat from the coolant to the airflow. It is contemplated that the circuit can further include a conventional surge tank 54, a second radiator 56, and additional selector valves, check valves, or rotary valves to reduce the capacity requirements of the pumps 30, 34 and manage the thermal requirements of the vehicle.

Figure 2:
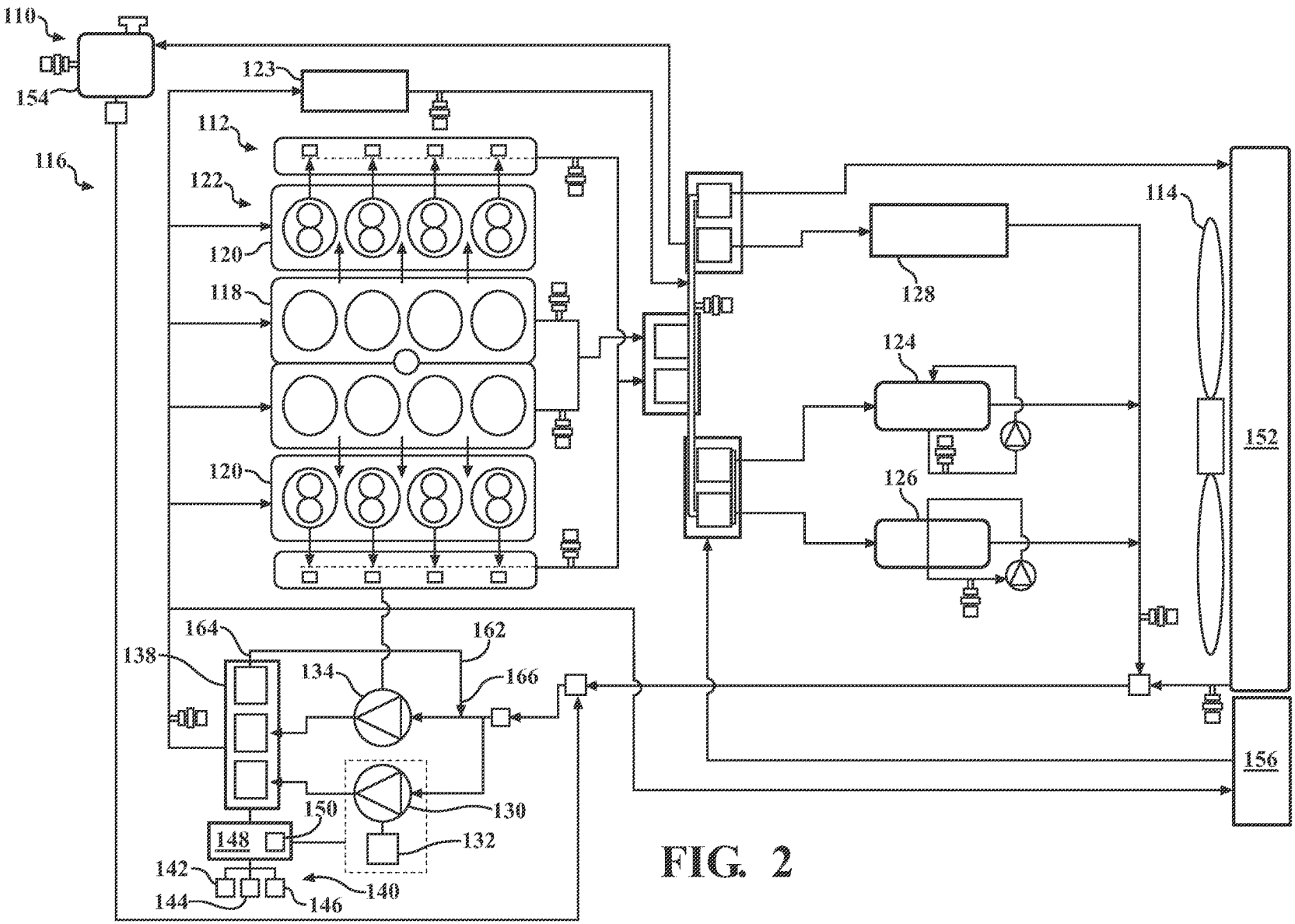
FIG. 2 is a schematic view of another embodiment of the engine cooling system of FIG. 1.

Referring to FIG. 2, another embodiment of an engine cooling system 110 is similar to the engine cooling system 10 of FIG. 1 and includes the same components identified by the same numbers increased by 100. While the system 10 of FIG. 1 includes the clutch 136 movable between engaged and disengaged states for selectively transmitting torque from the engine 112 to the mechanical water pump 134, the system 110 of FIG. 2 does not include a clutch. The mechanical water pump 134 is coupled to and continuously driven by the crankshaft of the engine when engine is running. The selector valve 138 can be disposed in a first state where it fluidly connects the electric water pump 130 to the engine 112 and it also fluidly connects the mechanical water pump 134 to a recirculation loop while the crankshaft of the engine continues to drive the impeller driveshaft of the mechanical water pump 134. More specifically, the recirculation loop defines a recirculation passage 162 configured to recirculate coolant through the mechanical water pump 134 when the electric water pump 130 is fluidly connected to the engine 112. The recirculation passage 162 includes an inlet 164 coupled to the selector valve 138 downstream of the mechanical water pump 134 and an outlet 166 coupled to the circuit 116 upstream of the mechanical water pump 134. Furthermore, the valve 138 can be movable to a second state where the valve 138 fluidly connects the mechanical water pump 134 to the engine 112.

In response to the ECM 148 determining that the predetermined flow rate is at or below the maximum electric pump flow rate, the ECM 148 is configured to generate a valve signal for actuating the selector valve 138 to fluidly connect the electric water pump 130 to the engine 112 and fluidly connect the mechanical water pump 134 to the recirculation passage 162. In response to the ECM 148 determining that the predetermined flow rate is above the maximum electric pump flow rate, the ECM 148 is configured to generate a valve signal for actuating the selector valve 138 to fluidly connect the mechanical water pump 134 to the engine 112 and deactivate the electric water pump 130.

In response to the ECM 148 determining that the predetermined current is at or below the maximum current, the ECM 148 is configured to generate a valve signal for actuating the selector valve 138 to fluidly connect the electric water pump 130 to the engine 112 and fluidly connect the mechanical water pump 134 to the recirculation passage 162. In response to the ECM 148 determining that the predetermined current is above the maximum current, the ECM 148 is configured to generate a valve signal for actuating the selector valve 138 to fluidly connect the mechanical water pump 134 to the engine 112 and deactivate the electric water pump 130.

Figure 3:
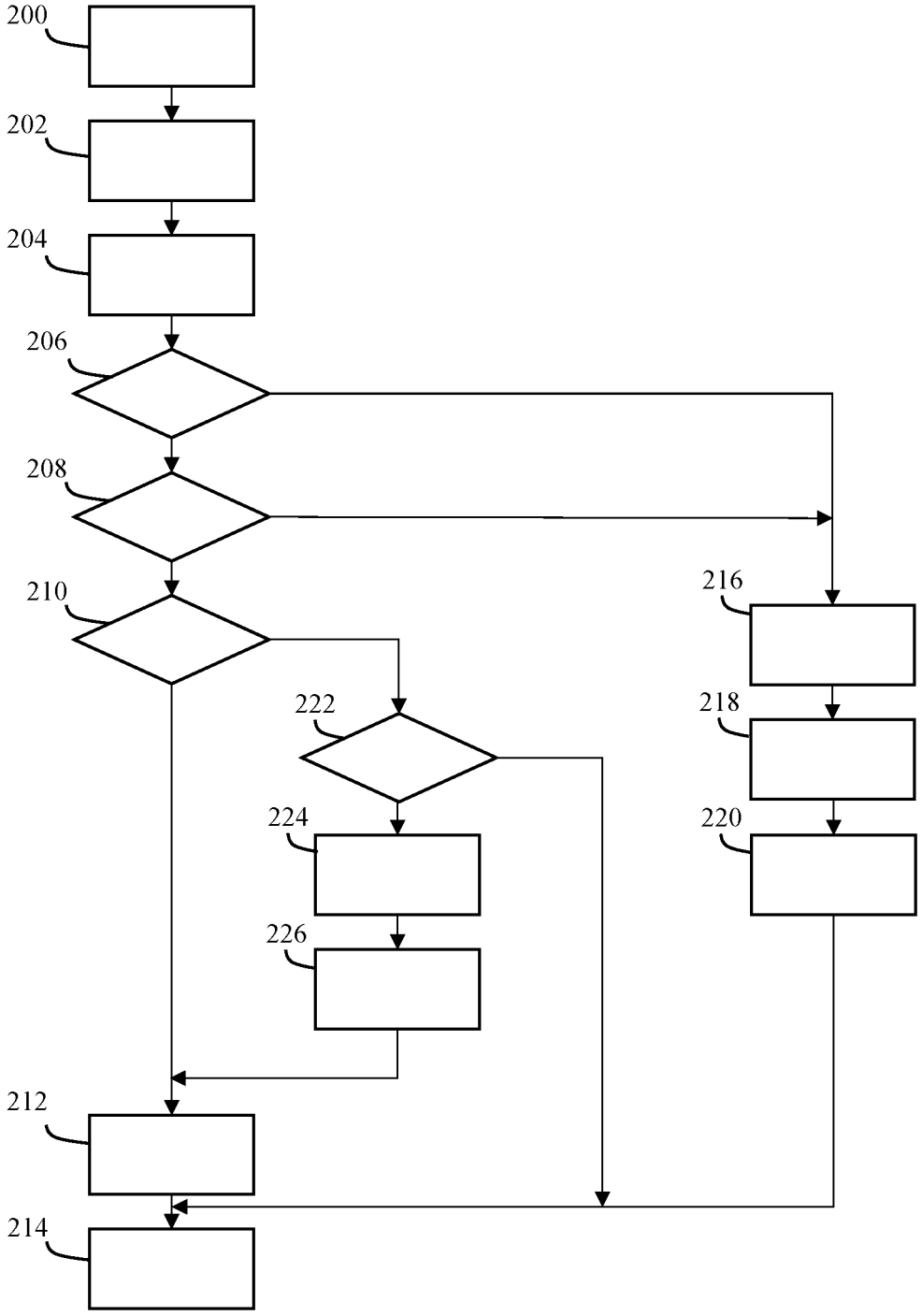
FIG. 3 is a flowchart of a method of using the engine cooling system of FIG. 1.

Referring now to FIG. 3, there is shown a method for using the system 10 of FIG. 1 to control the temperature of the engine 12 of the motor vehicle. At step 200, the method begins with the step of using one or more input sensors 40 to measure at least one characteristic of energy demand on the engine. It is contemplated that the input sensors can be configured to measure the thermal requirements of the engine 12, the EGR system, the engine oil heater, the transmission oil heater, the heater core for a climate control system, other suitable vehicle devices, or any combination thereof. This step may include the crank angle sensor 42 measuring a speed of the engine 12, the throttle position sensor 44 (TPS) measuring an accelerator opening degree, or the switch 46 switching on or off the heater for the climate control system of passenger cabin, other suitable input sensors, or any combination thereof. Other sensors can be used to measure other characteristics of energy demand on the motor vehicle.

At step 202, the method includes using the input sensors 40 to generate a signal representative of the measured energy demand characteristic. Continuing with the previous examples, the crank angle sensor 42, the throttle position sensor 44 (TPS), and the switch 46 may generate corresponding signals indicative of the respective measurements.

At step 204, the ECM 48 compares the energy demand characteristics as measured by the input sensors 40 to energy demand data stored within the memory 50 of the ECM 48 to identify the predetermined flow rate and the predetermined current for the electric water pump 30. However, it is contemplated that the memory 50 can have a lookup table that can be used to compare the measured energy demand characteristics to the energy measurement data to determine any other suitable control parameter associated with controlling the electric water pump 30 or the mechanical water pump 34.

At step 206, the ECM 48 determines whether the predetermined flow rate corresponding with the measured energy demand characteristic is at or below the maximum electric pump flow rate of the electric water pump 30. In response to the ECM 48 determining that the predetermined flow rate is at or below the maximum electric pump flow rate, the method proceeds to step 208. In response to the ECM 48 determining that the predetermined flow rate is above the maximum electric pump flow rate, the method proceeds to step 216.

At step 208, the ECM 48 determines whether the predetermined current is at or below the maximum current of the electric water pump 30. In response to the ECM 48 determining that the predetermined current is at or below the maximum current, the method proceeds to step 210 in response to the ECM 48 determining that the predetermined current is above the maximum current, the method proceeds to step 216.

At step 210, the ECM 48 determines whether the mechanical water pump 34 is engaged and currently circulating coolant through the circuit 16. In response to the ECM 48 determining that the mechanical water pump 34 is not currently circulating coolant through the circuit 16, the ECM determines that the electric water pump 30 is currently circulating coolant through the circuit 16, and the method proceeds to step 212. In response to the ECM 48 determining that the mechanical water pump 34 is currently circulating coolant through the circuit 16, the ECM 48 method proceeds to step 222.

At step 212, the ECM 48 actuates the electric water pump 30 to circulate coolant at the predetermined flow rate based on the measured energy demand characteristic. If the electric water pump 30 had been circulating coolant at a flow rate above or below the predetermined flow rate, the ECM actuates the electric water pump to begin circulating fluid at the predetermined flow rate. If the electric water pump 30 had already been circulating coolant at the same predetermined flow rate, the ECM actuates the electric water pump to continue circulating fluid at the same rate. Furthermore, when the electric water pump 30 circulates coolant, the clutch 36 is disposed in the disengaged position such that the clutch does not transmit torque from the engine 12 to the mechanical water pump 34. In other embodiments without a clutch where the mechanical water pump continuously receives torque from the engine, the mechanical water pump may be fluidly connected to the recirculation loop when the electric water pump is fluidly connected to the engine.

At step 214, the system circulates coolant through the circuit to control the temperature of the engine and manage the thermal requirements of the vehicle.

At step 216, the mechanical water pump 34 is engaged and driven by the engine 12. The step may be accomplished by the ECM 48 sending a clutch signal to the clutch 36 for moving the clutch 36 to the engaged state such that the clutch 36 transmits torque from the engine 12 to the impeller drive shaft of the mechanical water pump 34. However, in other embodiments, the mechanical water pump may be continuously driven by the engine or selectively engaged by other driving mechanisms.

At step 218, the ECM 48 sends the valve signal to the selector valve 38 for actuating the selector valve 38 to fluidly connect the mechanical water pump 34 to the engine 12.

At step 220, the ECM 48 deactivates the electric water pump 30, and the method proceeds to step 214.

At step 222, the ECM 48 determines whether the mechanical water pump 34 has been circulating coolant for a period of time equal to or exceeding a minimum time threshold. In response to the ECM 48 determining that the mechanical water pump 34 has not been circulating coolant less than the minimum time threshold, the method immediately proceeds to step 214 where the mechanical water pump 34 is not deactivated so as to prevent the pump 34 and the clutch 36 from rapidly cycling between the engaged and disengaged states. In response to the ECM 48 determining that the mechanical water pump 34 has been circulating coolant for a period of time equal to or longer than the minimum time threshold, the method proceeds to step 224.

At step 224, the mechanical water pump 34 is disengaged or deactivated. Continuing with the previous example, the ECM 48 can send a clutch signal to the clutch 36 for moving the clutch to the disengaged state where the clutch does not transmit torque from the engine to the mechanical water pump 34. However, in another embodiment without the clutch, the mechanical water pump 34 may be fluidly connected to the recirculation loop and fluidly disconnected from the engine, while the mechanical water pump is continuously engaged and driven by the engine.

At step 226, the ECM 48 sends the valve signal to the selector valve 38 for actuating the selector valve 38 to fluidly connect the electric water pump 30 to the engine 12. In another embodiment where the mechanical water pump is continuously driven by the engine, the valve signal may actuate the selector valve 38 to recirculate coolant from the outlet of the mechanical water pump to its inlet. The method proceeds to step 212.

The description of the present disclosure is merely exemplary in nature and variations that do not depart from the general sense of the present disclosure are intended to be within the scope of the present disclosure. Such variations are not to be regarded as a departure from the spirit and scope of the present disclosure.

What is claimed is:

1. An engine cooling system for controlling the temperature of an engine of a motor vehicle, the engine cooling system comprising:

a fan for creating an airflow;

an engine cooling circuit for circulating a coolant to transfer heat from the engine to the airflow, the engine cooling circuit comprising:

an electric water pump configured to circulate the coolant through the engine cooling circuit at a maximum electric pump flow rate;

a mechanical water pump configured to circulate the coolant through the engine cooling circuit at a maximum mechanical pump flow rate; and a selector valve configured to fluidly connect one of the electric water pump and the mechanical water pump to the engine;

at least one input sensor configured to measure at least one characteristic of an energy demand on the engine and generate a signal representative of the measured energy demand characteristic; and an engine control module electrically coupled to the electric water pump, the mechanical water pump, the selector valve, and the at least one input sensor, wherein the engine control module includes a memory that contains energy demand data, the energy demand data being associated with a predetermined flow rate;

wherein the engine control module is configured to:

compare the energy demand characteristics as measured by the at least one input sensor to the energy demand data for identifying the predetermined flow rate;

compare the predetermined flow rate to the maximum electric pump flow rate; and based on the comparison between the predetermined flow rate and the maximum electric pump flow rate, generate a valve signal for actuating the selector valve to fluidly connect one of the electric water pump and the mechanical water pump to the engine.

2. The system of claim 1 wherein the maximum mechanical pump flow rate is higher than the maximum electric pump flow rate.

3. The system of claim 1 wherein the engine control module is configured to generate a valve signal for actuating the selector valve to fluidly connect the electric water pump to the engine, in response to the engine control module determining that the predetermined flow rate is at or below the maximum electric pump flow rate.

4. The system of claim 3 wherein the engine control module is configured to actuate the electric water pump to circulate coolant in the engine cooling circuit, in response to the engine control module determining that the predetermined flow rate is at or below the maximum electric pump flow rate.

5. The system of claim 1 wherein the engine control module is further configured to generate a valve signal for actuating the selector valve to fluidly connect the mechanical water pump to the engine, in response to the engine control module determining that the predetermined flow rate is above the maximum electric pump flow rate.

6. The system of claim 5 further comprising a clutch coupled to the engine and the mechanical water pump, with the clutch movable between an engaged state where the clutch transmits torque from the engine to the mechanical water pump and a disengaged state where the clutch does not transmit torque from the engine to the mechanical water pump, wherein the engine control module is configured to generate a clutch signal for actuating the clutch to move to one of the disengaged state and the engaged state, based on the comparison between the predetermined flow rate and the maximum electric pump flow rate.

7. The system of claim 6 wherein the clutch is moved to the engaged state for a period of time equal to or exceeding a minimum time threshold, in response to the engine control module determining that the predetermined flow rate is above the maximum electric pump flow rate.

8. The system of claim 7 wherein the clutch is moved to the disengaged state, in response to the engine control module determining that the predetermined flow rate is at or below the maximum electric pump flow rate.

9. An engine cooling system for controlling the temperature of an engine of a motor vehicle, the engine cooling system comprising:

a fan for creating an airflow;

an engine cooling circuit for circulating a coolant to transfer heat from the engine to the airflow, the engine cooling circuit comprising:

an electric water pump configured to draw a maximum current to circulate the coolant through the engine cooling circuit at a maximum electric pump flow rate, wherein the electric water pump comprises one of a brushless DC motor and a brushed DC motor;

a mechanical water pump configured to circulate the coolant through the engine cooling circuit at a maximum mechanical pump flow rate, wherein the maximum mechanical pump flow rate is higher than the maximum electric pump flow rate;

a selector valve configured to fluidly connect one of the electric water pump and the mechanical water pump to the engine; and at least one input sensor configured to measure at least one characteristic of an energy demand on the engine and generate a signal representative of the measured energy demand characteristic; and an engine control module electrically coupled to the selector valve, the electric water pump, the mechanical water pump, and the at least one input sensor, wherein the engine control module includes a memory that contains energy demand data, wherein the energy demand data is associated with a predetermined flow rate and a predetermined current for the electric water pump;

wherein the engine control module is configured to:

compare the energy demand characteristics as measured by the at least one input sensor to the energy demand data for identifying the predetermined flow rate and the predetermined current;

compare the predetermined flow rate to the maximum electric pump flow rate;

compare the predetermined current to the maximum current; and based on the comparisons, generate a valve signal for actuating the selector valve to fluidly connect one of the electric water pump and the mechanical water pump to the engine.

10. The system of claim 9 wherein the engine control module is configured to actuate the electric water pump to circulate coolant at the predetermined flow rate, in response to the engine control module determining that the predetermined flow rate is at or below the maximum electric pump flow rate and in further response to the engine control module determining that the predetermined current is at or below the maximum current.

11. The system of claim 10 wherein the engine control module is further configured to deactivate the mechanical water pump and generate the valve signal for actuating the selector valve to fluidly connect the electric water pump to the engine, in response to the engine control module determining that the mechanical water pump has been circulating coolant for a time period equal to or exceeding a minimum time threshold.

12. The system of claim 9 wherein, in response to the engine control module determining that the predetermined flow rate is at or below the maximum electric pump flow rate, the engine control module is configured to:

actuate the electric water pump to circulate coolant;

generate the valve signal for actuating the selector valve to fluidly connect the electric water pump to the engine.

13. The system of claim 9 wherein, in response to the engine control module determining that the predetermined current is above the maximum current, the engine control module is configured to:

actuate the mechanical water pump to circulate coolant; and generate the valve signal for actuating the selector valve to fluidly connect the mechanical water pump to the engine.

14. The system of claim 9 further comprising a clutch coupled to the engine and the mechanical water pump, with the clutch movable between an engaged state where the clutch transmits torque from the engine to the mechanical water pump and a disengaged state where the clutch does not transmit torque from the engine to the mechanical water pump, wherein the engine control module is configured to generate a clutch signal for actuating the clutch to move to the disengaged state, in response to the engine control module determining that:

the predetermined flow rate is at or below the maximum electric pump flow rate; and the predetermined current is at or below the maximum current.

15. The system of claim 14 wherein the engine control module is configured to generate a clutch signal for actuating the clutch to move to the engaged state, in response to the engine control module determining that at least one of:

the predetermined flow rate is above the maximum electric pump flow rate; and the predetermined current is above the maximum current.

16. The system of claim 9 wherein the engine cooling system further comprises a recirculation passage, with the recirculation passage including an inlet coupled to the selector valve downstream of the mechanical water pump and an outlet coupled to the engine cooling circuit upstream of the mechanical water pump, wherein the engine control module generates the valve signal for actuating the selector valve to fluidly connect the mechanical water pump to the recirculation passage, in response to the engine control module determining that:

the predetermined flow rate is at or below the maximum electric pump flow rate; and the predetermined current is at or below the maximum current.

17. A method for operating an engine cooling system to control the temperature of an engine of a motor vehicle, the engine cooling system including a fan and an engine cooling circuit, where the engine cooling circuit includes an electric water pump configured to draw a maximum current to circulate coolant at a maximum electric pump flow rate, a mechanical water pump configured to circulate coolant at a maximum mechanical pump flow rate that is higher than the maximum electric pump flow rate, and a selector valve, and the engine cooling system further includes at least one input sensor and an engine control module electrically coupled to the electric water pump, the mechanical water pump, the selector valve, and the at least one input sensor, with the engine control module including a memory that contains energy demand data associated with a predetermined flow rate and a predetermined current, the method comprising:

measuring, using the at least one input sensor, at least one characteristic of an energy demand on the engine;

generating, using the at least one input sensor, a signal representative of the measured energy demand characteristic;

comparing, using the engine control module, the energy demand characteristics as measured by the at least one input sensor to the energy demand data to identify the predetermined flow rate and the predetermined current;

comparing, using the engine control module, the predetermined flow rate to the maximum electric pump flow rate;

comparing, using the engine control module, the predetermined current to the maximum current; and based on these comparisons, generating a valve signal for actuating the selector valve to fluidly connect one of the electric water pump and the mechanical water pump to the engine.

18. The method of claim 17 further comprising, in response to the engine control module determining that the predetermined flow rate is at or below the maximum electric pump flow rate and further determining that the predetermined current is at or below the maximum current:

generating a valve signal for actuating the selector valve to fluidly connect the electric water pump to the engine; and actuating the electric water pump to circulate coolant at the predetermined flow rate in the engine cooling circuit.

19. The method of claim 18 further comprising, in response to the engine control module determining that the mechanical water pump has been circulating coolant for a time period equal to or exceeding a minimum time threshold:

deactivating the mechanical water pump; and generating the valve signal for actuating the selector valve to fluidly connect the electric water pump to the engine.

20. The method of claim 17 further comprising, in response to the engine control module determining that the predetermined flow rate is above the maximum electric pump flow rate or in response to the engine control module determining that the predetermined current is above the maximum current:

generating a valve signal for actuating the selector valve to fluidly connect the mechanical water pump to the engine; and actuating the mechanical water pump to circulate coolant in the engine cooling circuit.

* * * * *